US006761102B2

(12) United States Patent
Giza

(10) Patent No.: US 6,761,102 B2
(45) Date of Patent: Jul. 13, 2004

(54) RECOIL CONTROL MECHANISM FOR A WEAPON

(75) Inventor: Richard Giza, Keysborough (AU)

(73) Assignee: Vader PTY LTD, Victoria (AU)

( * ) Notice: Subject to any disclaimer, the term of this patent is extended or adjusted under 35 U.S.C. 154(b) by 0 days.

(21) Appl. No.: 10/233,275

(22) Filed: Aug. 30, 2002

(65) Prior Publication Data

US 2003/0056639 A1 Mar. 27, 2003

Related U.S. Application Data

(63) Continuation of application No. PCT/AU01/00220, filed on Mar. 2, 2001.

(30) Foreign Application Priority Data

Mar. 2, 2000 (AU) ..... PQ5987

(51) Int. Cl.[7] ..... F41A 21/36; F41A 25/00; F41A 25/10

(52) U.S. Cl. ..... 89/194; 89/161

(58) Field of Search ..... 89/194, 195, 196, 89/197, 161

(56) References Cited

U.S. PATENT DOCUMENTS

| | | | | | |
|---|---|---|---|---|---|
| 3,672,255 | A | * | 6/1972 | Findlay et al. | 89/42.01 |
| 3,906,833 | A | * | 9/1975 | Orozco | 89/196 |
| 4,019,423 | A | * | 4/1977 | Johnson | 89/178 |
| 4,088,057 | A | | 5/1978 | Nasypany | |
| 4,476,969 | A | * | 10/1984 | Dykema | 188/380 |
| 4,635,530 | A | * | 1/1987 | Weldle | 89/159 |
| 4,649,800 | A | * | 3/1987 | Tessier | 89/194 |
| 5,457,901 | A | | 10/1995 | Gernstein | |
| 5,827,991 | A | | 10/1998 | Predazzer | |
| 6,212,991 | B1 | * | 4/2001 | Frazier, III | 89/196 |
| 6,595,103 | B1 | * | 7/2003 | Kathe | 89/198 |

FOREIGN PATENT DOCUMENTS

| | | |
|---|---|---|
| DE | 195 24 418 A1 | 1/1997 |
| EP | 0 738 864 A1 | 10/1996 |

OTHER PUBLICATIONS

Derwent Abstract Acession No. E5453Y/22, Dec, 28, 1976.

* cited by examiner

*Primary Examiner*—Peter M. Poon
*Assistant Examiner*—John W. Zerr
(74) *Attorney, Agent, or Firm*—Lowe Hauptman Gilman & Berner, LLP

(57) ABSTRACT

A recoil control mechanism for a weapon which fires a projectile which is characterized by the generation of a forward counterforce to the rearward recoil simultaneously with absorption of rearward recoil force upon initiation of propoulsion of the projectile. The forward counterforce is generated by propelling a first mass forwardly upon firing the projectile and substantially simultaneously propelling a second mass rewardly for absorbing some of the recoil force. In one mechanism (10), the first mass may be the weapon's barrel (12) and the second mass its breach block (14). Expaning gases (36) from detonation of propellant in cartridge (24) enter a reaction volume (28) between the barrel (12) and breech block (14). These gases drive barrel (12) forwardly against force transmission spring (16) to impose a forward counterforce on the weapon's frame (18). Substantially simultaneously recoil from detonation of cartridge (22) together with the gasses (36) in reaction volume (28) drive breech block (14) rearwardly against force absorbing spring (20).

17 Claims, 4 Drawing Sheets

RECOIL CONTROL MECHANISM FOR A WEAPON

This application is a Continuation of PCT International Application No. PCT/AU01/00220, filed on Mar. 2, 2001.

TECHNICAL FIELD

The present invention relates to a weapon and in particular to a recoil control mechanism for a weapon. The invention will be described generally in relation to a firearm, however it is to be understood that the invention is applicable to other forms of weapons for firing a projectile. Thus the weapon may, for example, be a large calibre weapon which is supported on a mounting such as a stand or platform instead of a hand held portable weapon such as a firearm.

In this specification the term "projectile" is to be understood as encompassing one piece generally solid projectiles such as bullets, pellets, darts, flechettes, artillery warheads, projectiles as in for example WO 97/04281, mortar shells (eg. 120 mm) or rocket boosted artillary shells, plus multiple piece charges which are fired as one, such as the shot in a shotgun cartridge or a plurality of bullets fired as one.

BACKGROUND

A problem with all weapons which fire a projectile, particularly those that rely upon detonation of an explosive propellant, is recoil. That is, firing the weapon (for example by detonation of a charge of explosive propellant within the weapon) produces a forward propelling thrust on the projectile and an equal and opposite rearward force, or recoil. Recoil limits the accuracy and portability of weapons. First it produces a force which has the effect of rotating the weapon about the centre of gravity of the weapon and its support (which for a firearm would be the shooter), resulting in vertical climb and lateral drift of the muzzle end of the barrel for succeeding firings. Recoil forces also cause torque, which has the effect of 'twisting' the weapon. The muzzle is thrown off the target in an irregular half circular motion around the longitudinal axis of the barrel. Similar to the effect of muzzle climb, the time of reacquisition of the target is therefore increased for subsequent rounds and accuracy is therefore significantly affected.

During automatic firing recoil can significantly affect the accuracy of the succeeding rounds. Second, the force of recoil must be absorbed by the weapon, or the shooter if the weapon is a firearm, or transmitted to a support mounting and thus to ground for heavier weapons such as artillery pieces. Thus it may cause discomfort and fatigue or even injury to a shooter, or require heavier supporting structures, or complex "soft" mounting carriages for mobile artillery weapons. Large masses are sometimes used in firearms to absorb the recoil velocity, however this compromises portability.

Clearly, if the recoil of a weapon could be substantially reduced if not eliminated within the weapon itself, it would reduce the above problems.

There are many known recoil reducing mechanisms, including arrangements which are initiated by the rapidly expanding gases produced by the detonation and burning of an explosive propellant. Generally, however, the known arrangements effectively only reduce the recoil without cancelling or at least substantially eliminating it.

SUMMARY OF THE INVENTION

An object of the present invention is to provide an improved recoil control mechanism.

The invention is characterised by the generation of a forward counterforce to the rearward recoil simultaneously with absorption of rearward recoil force momentarily after propulsion of the projectile is initiated.

Accordingly, in a first aspect the invention provides a recoil control mechanism for a weapon for firing a projectile in a forward direction which includes a first mass and a second mass which are driven in substantially opposite directions upon firing, wherein the first mass is driven in the forward direction to counter a rearward recoil of the weapon and the second mass is driven in the rearward direction for absorbing some of the recoil force.

The first mass and the second mass are solid inertial weights.

Preferably the mechanism includes a frame, the first mass and the second mass being associated with the frame for the frame to guide their respective forwards and rearwards movement, and including a force absorbing means which is operative between the second mass and the frame and a force transferring means which is operative between the first mass and the frame.

In a second aspect the invention provides a method of countering recoil of a weapon caused by the firing of a projectile, the method including providing a first mass to be driven forwardly in the same direction as the projectile to counter a rearwards recoil force and providing a second mass to be driven rearwardly against a force absorbing means for substantially simultaneously absorbing some of the rearwards recoil force.

The generation of a forward counterforce simultaneously with absorption of the residual recoil force over the time period of the recoil, allows the achievement of a resultant force-time characteristic which may be reasonably predetermined. For example, for a projectile which is fired by detonation of an explosive propellant, the recoil force of a weapon is reasonably calculable from, knowledge of the amount and type of propellant and the masses etc. that are involved, or it may be empirically determined experimentally, and from this appropriate parameters for the counterforce and recoil absorption sub mechanisms can be calculated (and possibly experimentally adjusted) to give a predetermined resultant force-time characteristic. Thus the invention gives an improved recoil control mechanism. It is envisaged that in some embodiments of the invention, the recoil of the weapon may be at least substantially eliminated if not fully cancelled (that is, the resultant force is substantially zero over the recoil time period). It is also considered that a resultant forward force could be generated.

Preferably the first mass is a barrel and the second mass is a breech block of the weapon and a means is provided associated with the barrel and a frame of the weapon for transferring a forwards force to the frame from the forward motion of the barrel. This means may include a compression spring or pneumatic or hydraulic piston and cylinder arrangement or electromagnetic means which is operative to return the barrel to its firing position.

The barrel and the breech block are also preferably biased towards each other relative to the frame of the weapon. This bias may be provided by a tension spring which is connected between the barrel and the breech block. Thus, as force from the forward momentum of the barrel is being transferred to the frame, the rearwards recoil force imparted to the breech block is being absorbed by the tension spring. Thus the tension spring provides a force absorbing means against which the breech block is driven. The tension spring may also be operative to restrain the breech block in its firing position momentarily upon detonation of the propellant to provide an adequate reaction surface for initiating the forward movement of the projectile and then to return it to its firing position after its rearward movement.

Alternatively the bias of the breech block and the barrel towards each other may be provided by means acting independently between the barrel and the frame and the breech block and the frame. Such means acting between the barrel and the frame may constitute the above described means for transferring a forwards force to the frame from the forward motion of the barrel. The independent means may each comprise a helical spring.

Although the preferred embodiment combines simultaneous "blow forward" of the barrel and "blow back" of the breech block to control recoil, as described above, it is to be understood that the invention may be realised in alternative embodiments. For example, it is envisaged that the first mass and the second mass may be additional components and that a gas for driving them apart may be tapped from the barrel or firing chamber. The recoil control mechanism may also be provided as an attachment per se for a weapon. Various of the foregoing or following features for biasing the breech block and barrel and providing gas reaction surfaces may be adapted to the masses of such alternative embodiments.

In the preferred arrangement wherein the first mass is a barrel and the second mass is a breech block of the weapon, a chamber for receiving a cartridge containing the projectile (such as a bullet) and explosive propellant is preferably provided at a loading end of the barrel. The chamber is associated with the barrel and the breech block to provide an interposed gas contact region therebetween for receiving expanding gases from the chamber upon firing of the projectile from the cartridge. Thus, upon firing of the cartridge, expanding gases from the propellant force the projectile from the cartridge and propel it through the barrel, and momentarily after initiation of the projectile's movement, the expanding gases following the projectile which emerge from the cartridge into the chamber expand into the interposed gas contact region to blow the barrel forward and simultaneously blow the breech block backwards to thereby reduce if not eliminate the recoil of the weapon. The chamber may be provided by the barrel, by the breech block, or the barrel and the breech block in combination, or by a separate chamber member. Preferably the component or components providing the chamber are in a structural relationship such that the interposed gas contact region is defined in part by at least two facing reaction surfaces, with each reaction surface being directly or indirectly associated with one of the barrel or the breech block. Preferably the reaction surfaces are substantially normally orientated relative to the forward and rearward directions to maximise the forces applied thereto in the forward and rearward directions by the gas pressure. The aforesaid structural relationship may be realised by a telescopic arrangement of one component relative to another, as will be described in more detail below.

It is to be understood that the weapon will include a firing mechanism for initiating detonation of the explosive propellant and in the preferred embodiment this may include a firing pin associated with the breech block which is operable via a trigger mechanism carried by the frame, as is known. The weapon may also provide for semi automatic or fully automatic operation utilising the energy stored during the blow back of the breech block, as is also known, in which case a magazine will need to be provided. A suitable firing mechanism and a mechanism for providing semi or fully automatic operation including a magazine for the cartridges will not be described in further detail herein as there are many such known mechanisms from which a person skilled in the art may choose to provide suitable such mechanisms for the weapon.

A weapon incorporating the invention, in its preferred form involving blow forward of the barrel, may include additional features associated with the barrel for increasing the forwards momentum thereof. Such additional features include, for example, the provision of a conical bore for the barrel and/or muzzle breaks for redirecting the gas from the barrel, as are known. The weapon in its preferred form may be a firearm such as a rifle, shotgun, pistol or revolver.

For a better understanding of the invention, the principle thereof for various embodiments, as well as a specific embodiment, which are given by way of non limiting example only, will now be described with reference to the accompanying drawings (which are not to scale).

DETAILED DESCRIPTION

Figure 1:
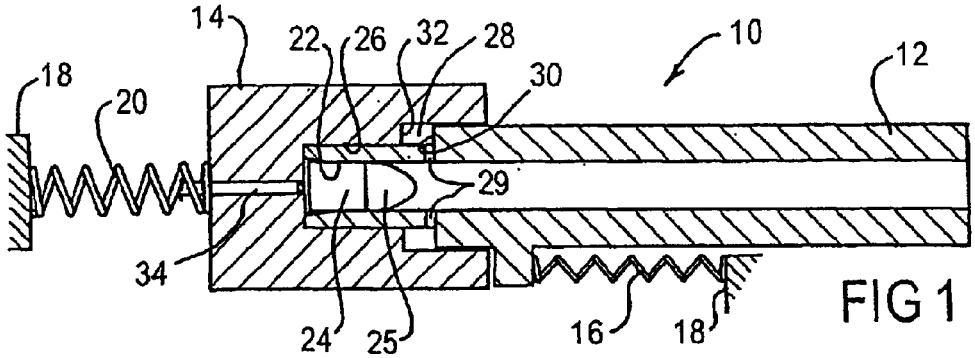
FIGS. 1 to 4 schematically illustrate the operating principle of the invention.

A recoil control mechanism 10 of a weapon as schematically shown in FIGS. 1 to 4 includes a first mass which is a barrel 12 of the weapon and a second mass which is a breech block 14 of the weapon. The barrel 12 is movable in a forward direction against a biasing means 16 relative to a frame 18 of the weapon and the breech block 14 is movable rearward against a biasing means 20 relative to the frame 18. The biasing means 16 and 20 may be helical compression springs. The barrel defines a chamber 22 at its loading end, for receiving a cartridge 24 with a bullet 25, and is telescopically received within a recess 26 in the breech block 14.

The recess 26 of the breech block and the barrel 12 are shaped such that when in the ready to fire position (FIG. 1) they define an interposed gas contact region, namely an annular volume 28. Ports 29 provide for gas flow from chamber 22 into volume 28. The interposed gas contact region 28 is defined in part by a reaction surface 30 on the barrel 12 and a facing reaction surface 32 on the breech block 14. The surfaces 30 and 32 lie substantially normally to the forward and rearward directions. A firing pin 34 is associated with the breech block 14.

Figure 2:
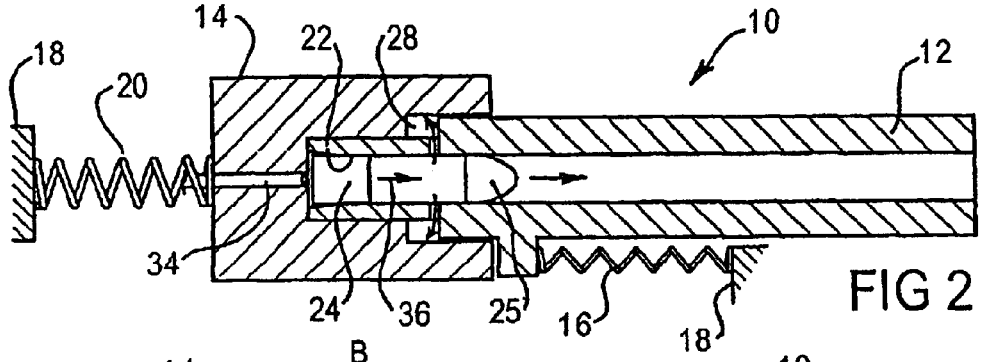
Figure 3:
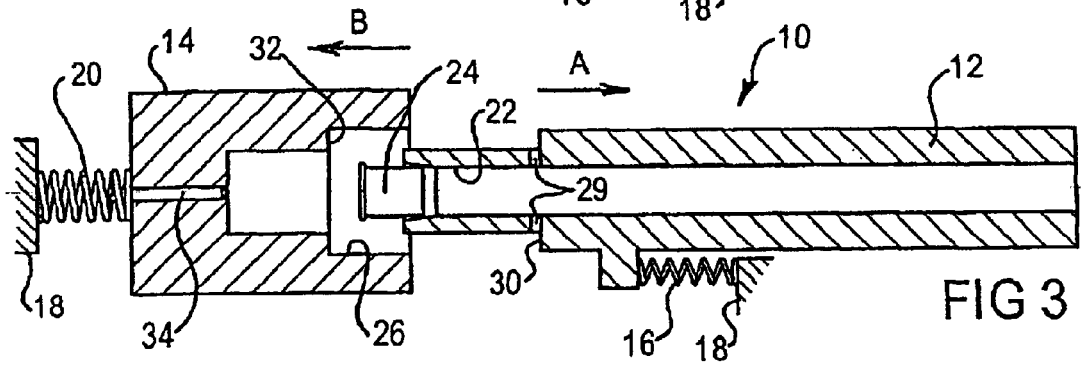

On firing, the rapidly expanding gases 36 from the explosive propellant in cartridge 24 propel bullet 25 into the bore of barrel 12 and also flow through ports 29 into the interposed gas contact region 28 (FIG. 2). The very high pressure gases entering region 28 act on reaction surfaces 30 and 32 and thus simultaneously force or "blow" the barrel 12 forwardly (arrow A, FIG. 3) and the breech block 14 rearwardly (arrow B, FIG. 3). Initiation of the blowing forward of the barrel 12 and blowing back of the breech block 14 occurs momentarily after firing because of the proximity of ports 29 and chamber 22. The force of the rearward or recoil movement of the breech block 14 is absorbed by biasing means 20 which has a suitable characteristic relative to that of biasing means 16 to ensure it stores a significant portion of the force instead of immediately transferring it to frame 18. Simultaneously, the force from the forward movement of barrel 12 is transferred to frame 18 via biasing means 16, which has a relatively stiffer characteristic compared to that of biasing means 20 to ensure that the counter recoil force is quickly transferred to the frame 18. Thus the rearward recoil which occurs upon detonation of the explosive in cartridge 24 and expansion of gases 36 therefrom to propel bullet 25 through barrel 12 is simultaneously both absorbed in biasing means 20 and countered by an oppositely directed force applied to frame 18 from barrel 12. The resultant of this may be to totally or at least substantially eliminate recoil of the weapon. At the limit of the forward movement of barrel 12 and rearward movement of breech block 14 (FIG. 4) the cartridge 24 is ejected by ejector 35 and the biasing means 16 and 20 are operative to restore the parts to their ready to fire positions.

Figure 4:
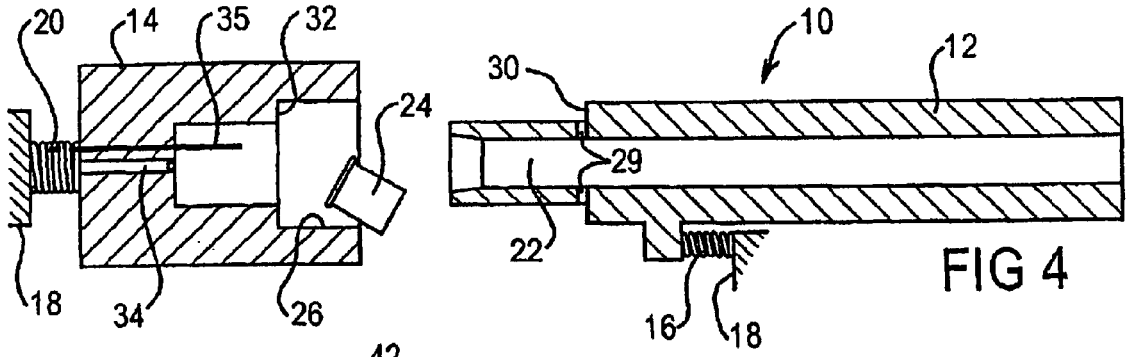
Figure 5:
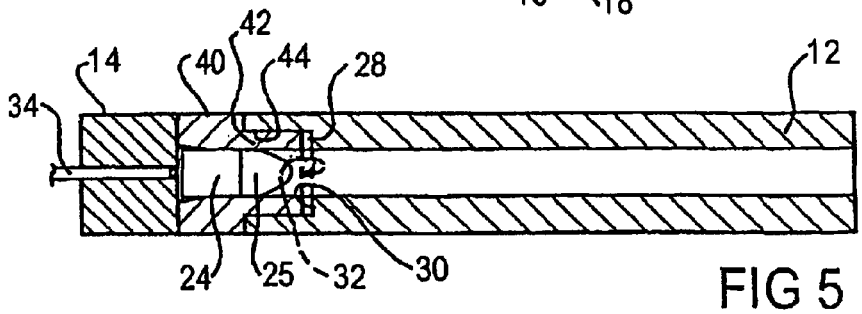
FIG. 5 schematically illustrates use of a barrel, chamber unit and breech block for the invention.

FIG. 5 schematically shows a modification wherein a chamber unit 40 is provided interposed between a breech block 14 and barrel 12 (the components of FIG. 5 which are equivalent to those in FIGS. 1 to 4 have been given the same reference numeral, but note that some features have been omitted from FIG. 5 for clarity). A forward cylindrical portion 42 of chamber unit 40 telescopically engages in a wider cylindrical recess 44 in barrel 12 to provide an interposed gas contact region 28 defined in part by facing reaction surfaces 30 and 32 of, respectively, the barrel 12 and the chamber unit 40. With this construction, the ports 29 are eliminated, however it functions the same as the construction of FIGS. 1 to 4.

The reaction surfaces of the interposed gas contact region may have any desired shape. Thus instead of being flat, as shown in FIGS. 1 to 5, they may have curved portions, be fluted, include depressions or be otherwise modified to increase the surface area upon which the rapidly expanding pressurised gases 36 act.

After the pressure of the expanding gases has reduced, the breech block 14 and barrel 12 are returned to the positions shown in FIG. 1 by the energy stored in biasing means 20 and 16, respectively. A mechanism for automatic ejection of the cartridge case 24 is indicated at 35 (FIG. 4). A mechanism for automatic loading of another cartridge in chamber 22 ready for firing is not shown in FIGS. 1 to 5, but as is known may be operated by the backward and then forward motion of the breech block 14, or alternatively the forward and then rearward motion of the barrel 12, or a combination of both.

FIGS. 6A to D illustrate in principle a weapon where recoil is controlled by simultaneous "blow forward" of a barrel and "blowback" of a breech block without use of an interposed gas contact region. Thus the figures show a weapon 50 which comprises a frame 52 on which is reciprocally mounted a barrel 54 biased rearwardly by a compression spring 56. The frame 52 also carries a breech block 58 which is biased forwardly by compression spring 60.

Figure 6A:
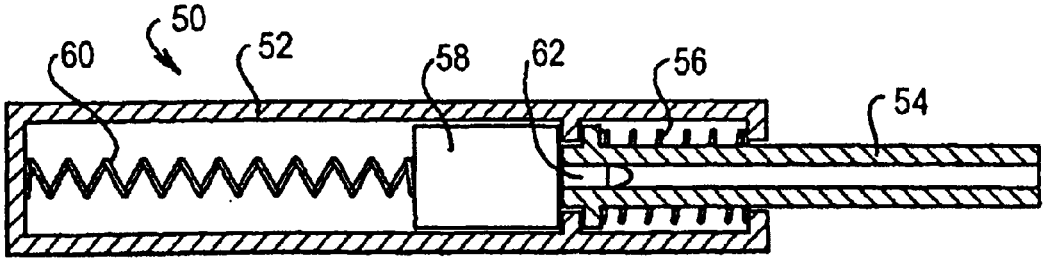
FIGS. 6A–D and 7A–F illustrate further embodiments in principle.
Figure 6B:
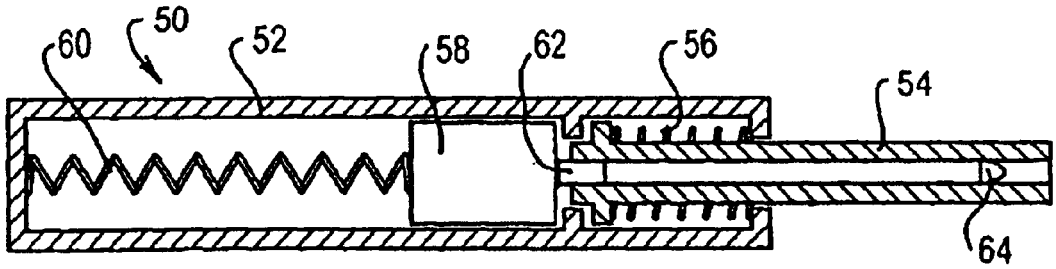
Figure 6C:
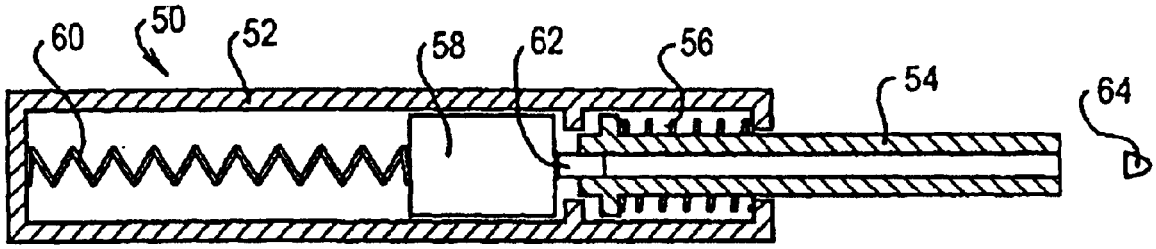
Figure 6D:
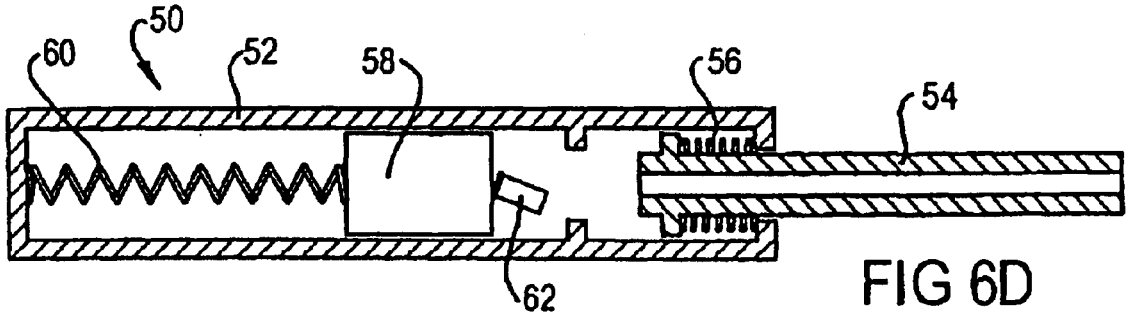

On detonation of a cartridge 62, the bullet 64 is propelled forwardly and its motion through the barrel 54 drives the barrel forwardly and this motion continues after the bullet 64 exits the barrel 54 (FIGS. 6B, C and D). Also upon firing, a rearwards force from the cartridge 62 is impacted on the breech block 58 and this drives the breech block rearwardly against the bias of spring 60. Spring 56 is relatively weak such that a forwards force is generated by the moving mass of barrel 54 to counter the rearwards recoil. Some of this force is transferred to frame 52 via spring 56 such that, combined, a substantial forwards counter to the rearwards recoil is generated. Simultaneously the recoil force imposed on breech block 58 is absorbed by spring 60. It is considered that the masses of barrel 54 and breech block 58 and the spring characteristics of springs 56 and 60 could be arranged such that recoil is effectively eliminated.

FIGS. 7A to F illustrate a weapon 80 having a frame 82 on which is mounted a barrel 84 and breech block 86. A moveable mass 88 surrounds the barrel 84. The barrel 84 is biased to its rest position relative to frame 82 by spring 90, and mass 88 is biased against an abutment 92 on barrel 84 relative to frame 82 by a double spring arrangement 94. Breech block 86 is biased forwardly relative to frame 82 by a spring 96. An interposed gas contact region is defined by facing surfaces of the abutment 92 on barrel 84 and an end face of the mass 88 and is in gas communication with a chamber part of the barrel 84 via passages 98.

Figure 7A:
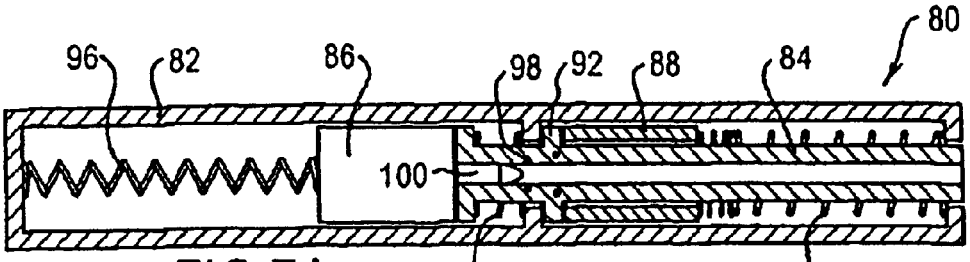
Figure 7B:
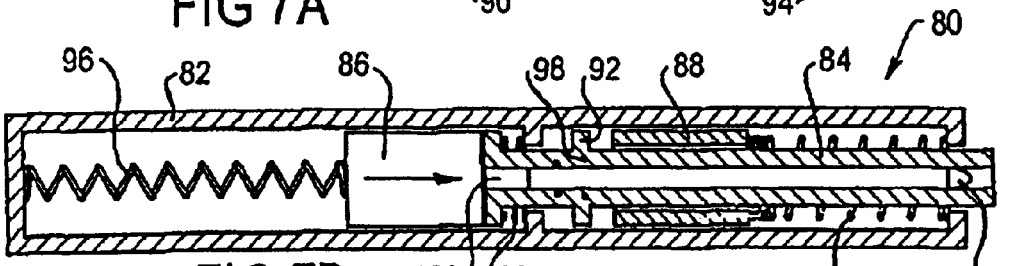
Figure 7C:
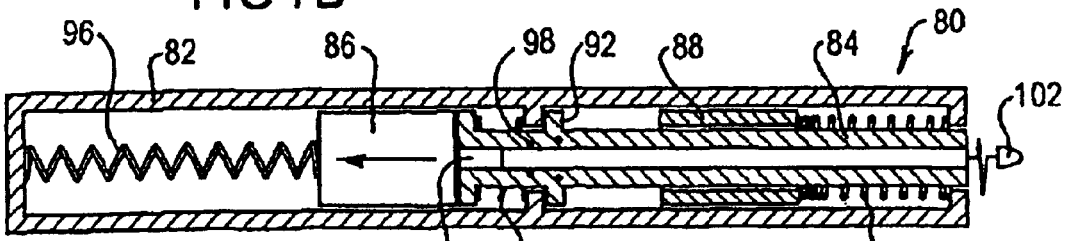
Figure 7D:
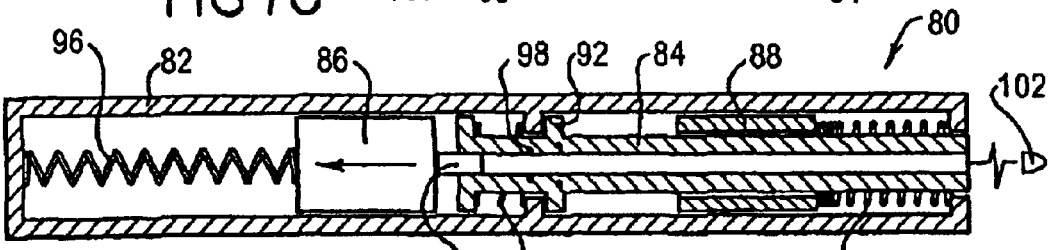
Figure 7E:
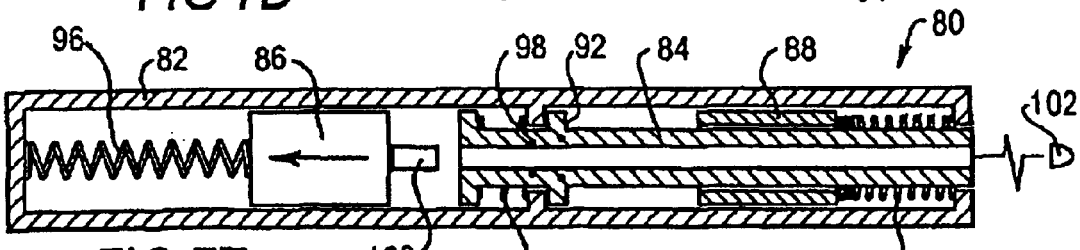
Figure 7F:
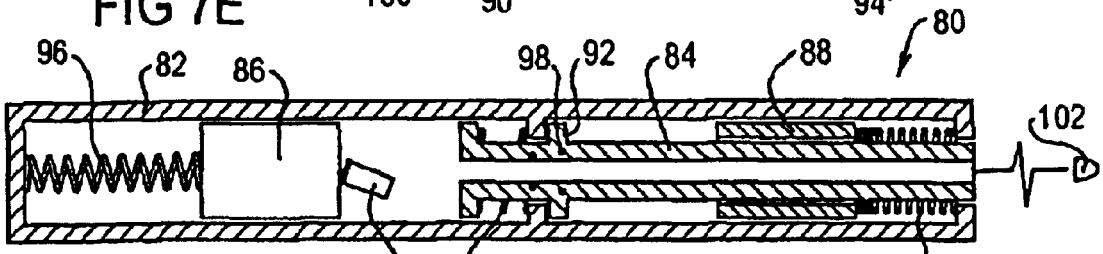

The sequence of events for recoil control in the weapon 80 upon firing of a cartridge 100 will be evident from FIGS. 7A to F. Thus, on detonation, the barrel is initially driven forwardly against the bias of spring 90 by bullet 102 and virtually instantaneously gas forces into the gas contact region to drive mass 88 forwardly against double spring 94, the initial portion of which is readily compressible (FIGS. 7A and B). Spring 96 drives breech block 86 forwardly with the barrel 84. Whilst mass 88 continues forwardly, barrel 84 is then driven rearwardly by spring 90 and gas pressure on abutment 92 to drive the breech block 86 rearwardly against spring 96 (FIGS. 7C, D and E). This extracts the cartridge case 100 from the chamber end of barrel 84. Mass 88 continues forwardly, but is now moving against a stronger bias provided by the second portion of the double spring arrangement 94 until it reaches its forward most position (FIG. 7F), at which point the breech block 86 also reaches substantially its rear most position. The mass 88 and breech block 86 are then reset to their initial positions by the energy which is stored in springs 94 and 96, respectively.

The initial forward movement of barrel 84, breech block 86 and mass 88 combined with the subsequent rearward movement of barrel 84 and breech block 86 against spring 96 simultaneously with continued forwards movement of mass 88 against double spring 94 allows for the recoil in the weapon 80 to be controlled.

An example weapon, namely a pistol 100 incorporating an embodiment of the invention, comprises a frame 102 (FIGS. 8 and 9) having a handle 104 within which a magazine 106 is received. Mounted on the frame 102 is a barrel 108 and a breech block in the form of a slide 110. A breech face 112 of the slide (best seen in FIG. 9) closes a chamber 114 provided by a chamber unit 116, and a forward portion 118 of the slide surrounds the barrel 108. Forward portion 118 of the slide 110 includes a bushing 120 for supporting the forward end of barrel 108 for relative movement therebetween.

The slide 110 is rearwardly movable relative to frame 102 against the bias provided by a helical compression spring 122 which acts between a boss 124 which is pinned to the frame 102 by a pin 126 and a spring holding bracket arrangement 128 provided on the forward portion 118 of the slide beneath barrel 108. A pin member 130 (which may be cylindrical) extends through bracket 124 for guiding and supporting the spring 122 as it compresses with rearwards movement of slide 110. The frame 102 includes an extension 132 for covering the spring 122.

The barrel 108 is forwardly movable relative to frame 102 against the bias provided by a helical compression spring 134 which acts between the boss 124 pinned to frame 102 and a depending lug 136 of the barrel 108. The pin member 130 is associated with the lug 136 for supporting spring 134. Pin member 130 can slide through boss 124. A rib on the lowermost surface of lug 136 of barrel 108 slides within a groove in the frame 102 to guide the barrel.

Figure 8:
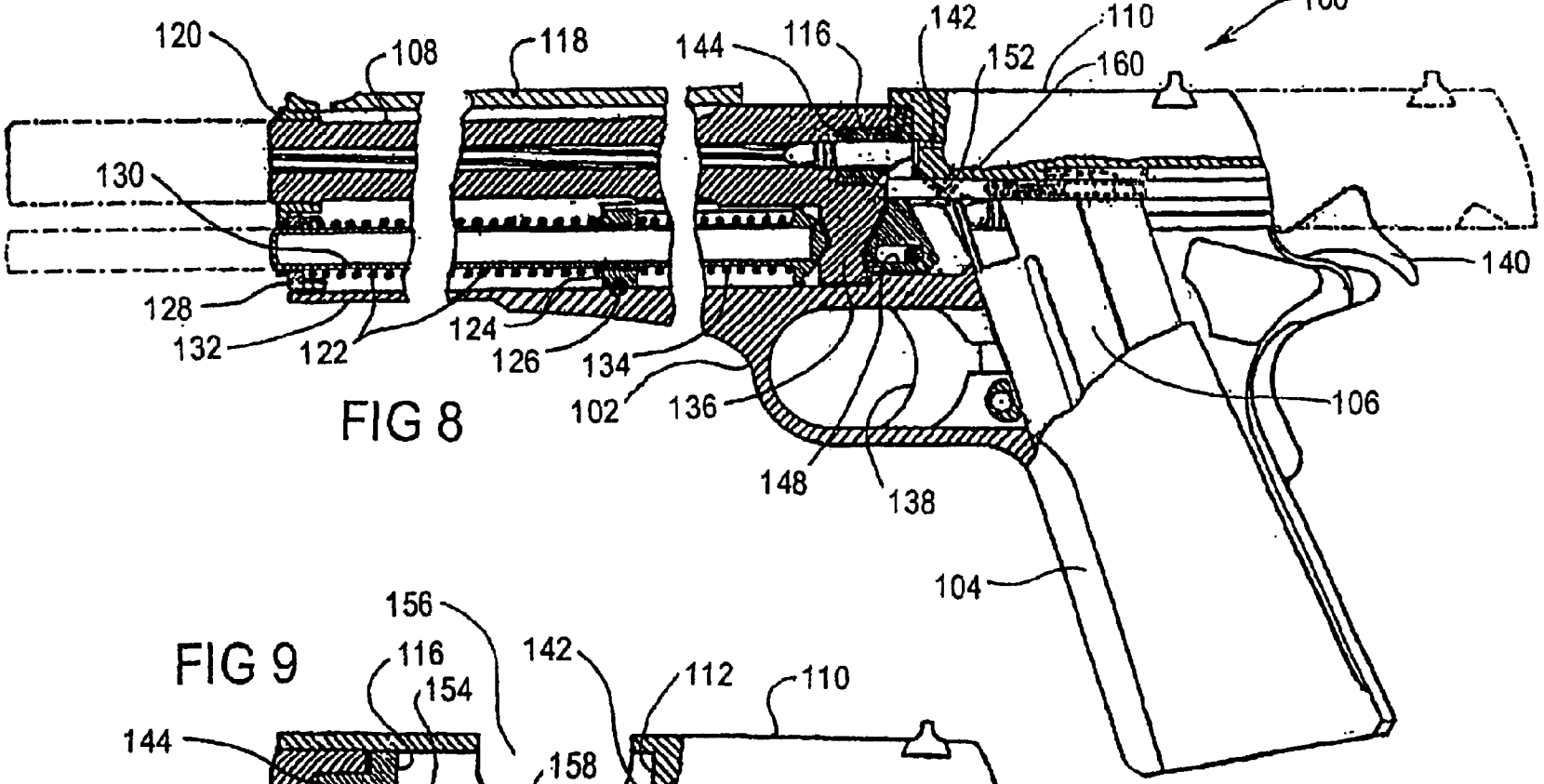
FIG. 8 is a partially sectioned side view of an embodiment of the invention in the form of an automatic pistol.

Frame 102 carries a firing mechanism which includes a trigger 138 and hammer 140 adapted to be cocked by the slide 110 when it moves rearward from the position shown in full lines in FIG. 8. Details of the firing mechanism are not shown but may be the same or similar to that in a Colt "Ace" pistol, upon which the present embodiment is modelled. When trigger 138 is pulled, the hammer 140 is released to strike the rear end of a firing pin 142 carried by the slide 110.

The chamber unit 116 includes a cylindrical forward portion for telescopically engaging within a cylindrical recess in the rear end of barrel 108 to provide an interposed gas contact region 144. The gas contact region is partly defined by facing reaction surfaces of the barrel and the chamber unit. The rear portion of chamber unit 116 includes a depending extension 146 (see FIG. 9) which includes a slot 148. A pin 150, which is fixed to the frame 102, passes through the slot 148 whereby the slot and pin 150 in combination define the forward and rearward limits of movement of the chamber unit 116. A V spring 152 is retained between the depending extension 146 of chamber unit 116 and a surface of frame 102 to bias the chamber unit 116 towards its forward most position. Extension 146 includes a rearward projection which has an inclined upper surface 154 (best shown in FIG. 9) for providing a ramp for guiding cartridges into the chamber 114.

The slide 110 includes an extractor adapted for engaging and withdrawing cartridges from chamber 114 when the slide 110 moves rearward. When the cartridge shell is drawn back by the extractor it is engaged by an ejector and thrown out through ejection opening 156 in the slide 110 (see FIG. 9).

The magazine 106 holds cartridges 158, the uppermost of which rests against a depending central rib 160 on the slide 110. The magazine is provided with a known spring follower to press the cartridges upward successively as each topmost cartridge is withdrawn and fired by the pistol 100.

FIG. 8 shows the pistol 100 loaded and cocked. Upon firing, the cartridge and chamber unit 116 recoil rearwardly (against the bias of V spring 152) and at virtually the same instant some of the high pressure expanding gases enter the gas contact region 144 and impinge on the reaction surfaces to blow the chamber unit 116 and barrel 108 apart. This drives the chamber unit 116 and slide 108 rearwardly against the bias of the spring 122. The chamber unit 116 stops when the forward end of slot 148 contacts pin 150, but slide 110 continues rearwardly for the recoil force to be further absorbed by spring 122. Simultaneously force from the forward movement of the barrel 108 is transferred to frame 102 via spring 134 acting between lug 136 and boss 124. This force counteracts the recoil, including that caused by extension 146 of chamber unit 116 striking pin 150 of frame 102. The combined blowing back of the slide 110 and blowing forward of barrel 108 together with the action of springs 122 and 134 relative to frame 102 allows for the recoil of the pistol 100 to be substantially eliminated.

Figure 9:
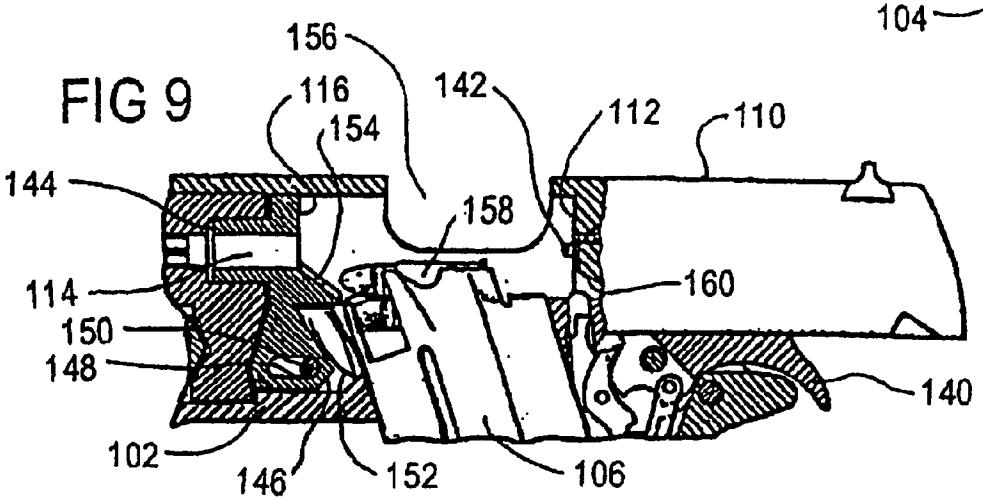
FIG. 9 is a partially sectioned view of a portion of the pistol of FIG. 8 showing the slide (that is breech block) in its rearmost position.

The slide 110 moves rearward to the position shown in FIG. 9 and thus recocks the firing mechanism. It is immediately returned forwardly by the energy stored in spring 122, during which movement its central rib 160 engages the top most cartridge 158 in magazine 106 and pushes it forwards into chamber 114 of chamber unit 116, by which time the chamber unit 116 has been reset by V spring 152. The cartridge 158 is guided into chamber 114 by the inclined ramp surface 154 of chamber unit 116. The slide 110 holds the chamber unit 116 forward in the position shown in FIG. 8. At the same time the barrel 108 is returned rearwardly to its normal position shown in FIG. 8 by the energy stored in spring 134. Recocking and reloading have thus been effected and the pistol 100 is ready to be fired again.

Although only a single detailed embodiment (FIGS. 8 and 9) has been described, the principle of the invention is not complex and is adaptable to other types of weapons without undue experimentation. Thus the invention is to be understood as applicable to weapons of much larger calibre, including mounted mobile or stationary artillery weapons. It is also considered that the invention is applicable to the types of weapons as disclosed in WO 94/20809 and WO 98/17962.

It is also to be understood that the invention is not restricted to applications where a projectile is fired via detonation of an explosive propellant, whether that propellant be encased, as in for example a cartridge, or otherwise presented for firing a projectile, as in for example caseless ammunition, or whether it be a solid, gaseous or liquid propellant. Thus, the invention is considered to be applicable to all types of weapons which fire a projectile and in which recoil occurs, notwithstanding the means or manner by which the high pressure is developed that is necessary to propel the projectile forwardly. It is considered that such means or manner may include for example electromagnetic (as in "rail guns") or electrothermal systems, air propulsion systems of various types and others.

Finally, it is to be understood that various alterations, modifications and/or additions may be made to the present invention without departing from the ambit thereof as defined by the scope of the following claims.

What is claimed is:

1. A recoil control mechanism for a weapon for firing a projectile in a forward direction, the mechanism including a first mass and a second mass which are driven in substantially opposite directions upon firing of the weapon, wherein the first mass is driven in the forward direction to counter a rearward recoil of the weapon and the second mass is driven in a rearward direction for absorbing some of the recoil force;

wherein the first mass and the second mass include reaction surfaces and a gas which is tapped from a firma chamber of the weapon upon firma enters between the reaction surfaces to drive the first mass and the second mass apart.

2. A recoil control mechanism as claimed in claim 1 including a frame, the first mass and the second mass being associated with the frame for the frame to guide their respective forward and rearward movement, and including a force absorbing means which is operative between the second mass and the frame and a force transferring means which is operative between the first mass and the frame.

3. A recoil control mechanism as claimed in claim 2 wherein the frame is attachable to the weapon for the mechanism to be operatively associated therewith for the first and second masses to be driven in said substantially opposite directions upon firing of the weapon.

4. A weapon for firing a projectile in a forward direction, the weapon including a recoil control mechanism as claimed in claim 1, 2 or 3.

5. A weapon as claimed in claim 4 wherein the first mass is associated with a barrel of the weapon such that the first mass and the barrel are driven forwardly, and the second mass is a breech block of the weapon.

6. A weapon as claimed in claim 5 wherein upon detonation of an explosive propellant for firing a projectile from the weapon, the barrel, first mass and breech block are initially driven forwardly and subsequently the barrel and breech block are driven rearwardly whilst the first mass continues forwardly.

7. A weapon as claimed in claim 5 wherein the barrel is biased rearwardly relative to a frame of the weapon towards a firing position, and the first mass is biased relative to the frame against an abutment on the barrel, and the breech block is biased forwardly relative to the frame towards the firing position, and wherein an interposed gas contact region is defined by facing surfaces between the abutment on the barrel and the first mass and which is in gas communication with a chamber provided by the barrel, wherein expanding gases from detonation of an explosive propellant within the chamber are operative to propel a projectile from the chamber through the barrel and thus to drive the barrel forwardly together with the first mass, the breech block being biased forwardly such that it simultaneously moves forwardly with the barrel until the expanding gases enter into the interposed gas contact region whereupon the breech block is driven rearwardly simultaneously with the first mass being driven forwardly, and wherein the movement of the barrel is reversed by the bias between it and the frame as the first in ass continues forwardly.

8. A weapon for firing a projectile in a forward direction, the weapon including a first mass and a second mass which are driven in substantially opposite directions upon firing of the weapon, wherein the first mass is driven in the forward direction to counter a rearward recoil of the weapon and the second mass is driven in a rearward direction for absorbing some of the recoil force, wherein the first mass is a barrel of the weapon and the second mass is a breech block of the weapon; wherein the barrel is associated with a chamber at a loading end of the barrel for receiving a cartridge containing a projectile and an explosive propellant, and the breech block and the barrel include an interposed gas contact region for receiving expanding gases from the chamber upon firing of the propellant for propelling the projectile through the barrel, which expanding gases blow the barrel forward and simultaneously blow the breech block backwards.

9. A weapon as claimed in claim 8 including means associated with the barrel and a frame of the weapon for transferring a forward force to the frame from the forward motion of the barrel.

10. A weapon as claimed in claim 9 wherein the means for transferring a forward force to the frame of the weapon from the forward motion of the barrel is a force transferring and force absorbing means, being one of a compression spring, a pneumatic or hydraulic piston and cylinder mechanism, and an electromagnetic mechanism.

11. A weapon as claimed in claim 10 wherein the force transferring and force absorbing means is operative to return the barrel to its firing position.

12. A weapon as claimed in claim 8 wherein the barrel and the breech block are biased towards each other relative to a frame of the weapon.

13. A weapon as claimed in claim 12, wherein the bias of the breech block and the barrel towards each other are provided by biasing means acting independently between, respectively, the barrel and the frame of the weapon, and the breech block and the frame of the weapon.

14. A weapon as claimed in claim 13 wherein the biasing means acting independently between, respectively, the barrel and the frame of the weapon, and the breech block and the frame of the weapon each comprise a helical compression spring.

15. A weapon as claimed in claim 8, wherein the chamber is provided by the barrel.

16. A weapon as claimed in claim 8, wherein the chamber is a separate component and the interposed gas contact region is defined in part by two facing reaction surfaces, each of which is associated with one of the barrel and the breech block.

17. A weapon as claimed in claim 16 wherein each of the two facing reaction surfaces is directly associated with one of the barrel and the breech block.

* * * * *

UNITED STATES PATENT AND TRADEMARK OFFICE

CERTIFICATE OF CORRECTION

PATENT NO. : 6,761,102 B2
APPLICATION NO. : 10/233275
DATED : July 13, 2004
INVENTOR(S) : Richard Giza It is certified that error appears in the above-identified patent and that said Letters Patent is hereby corrected as shown below:

Column 8, Line 49 “firma” should be --firing--.
Column 8, Line 50 “firma” should be --firing--.
Column 9, Lines 29-30 “in ass” should be --mass--.

Title Page Item (57) Abstract

Line 5, “propoulsion” should be --propulsion--

Line 10, “breach” should be --breech--

Llne 11, “Expaning” should be --Expanding--

Signed and Sealed this

Twentieth Day of March, 2007

JON W. DUDAS
*Director of the United States Patent and Trademark Office*